US005635795A

United States Patent [19]

Itoh et al.

[11] Patent Number: 5,635,795

[45] Date of Patent: Jun. 3, 1997

[54] GETTER CHAMBER FOR FLAT PANEL DISPLAYS

[75] Inventors: Shigeo Itoh; Takeshi Tonegawa; Mikio Yokoyama; Yuuich Kogure, all of Mobara, Japan

[73] Assignee: Futaba Denshi Kogyo K.K., Mobara, Japan

[21] Appl. No.: 274,770

[22] Filed: Jul. 14, 1994

[30] Foreign Application Priority Data

Jul. 14, 1993 [JP] Japan ..... 5-038567 U

[51] Int. Cl.[6] ..... H01J 63/04

[52] U.S. Cl. ..... 313/496; 313/495

[58] Field of Search ..... 313/495, 496, 313/497, 400, 422, 513, 552, 553

[56] References Cited

U.S. PATENT DOCUMENTS

| | | | |
|---|---|---|---|
| 4,047,073 | 9/1977 | Kishino | 313/497 |
| 4,455,774 | 6/1984 | Watanabe | 313/496 |
| 4,531,122 | 7/1985 | Refield | 313/400 |
| 4,767,965 | 8/1988 | Yamano et al. | 313/491 |
| 4,841,194 | 6/1989 | Kishino et al. | 313/496 |
| 4,874,987 | 10/1989 | van der Eijk et al. | 313/553 |
| 5,063,323 | 11/1991 | Longo et al. | 313/553 |
| 5,170,100 | 12/1992 | Shichao et al. | 313/422 |
| 5,223,766 | 6/1993 | Nakayama et al. | 313/495 |
| 5,444,331 | 8/1995 | Matsuno et al. | 313/553 |

*Primary Examiner*—Michael Horabik
*Assistant Examiner*—Michael Day
*Attorney, Agent, or Firm*—Oblon, Spivak, McClelland, Maier & Neustadt, P.C.

[57] ABSTRACT

A fluorescent display device (1) includes an air tight envelope (2) having a cathode substrate (3), an anode substrate (4) with a phosphor layer arranged to provide a luminous display, a seal member (5), an evacuation hole (9) formed at a side of the envelope (2), and a getter chamber (10) in communication with the hole (9). The getter chamber (10) is disposed on the outside of the envelope (2) and includes a chamber body (12), and an evacuation tube (13). The getter chamber (10) eliminates the independent formation of an evacuation hole in the cathode substrate (3), and thereby prevents damage and contamination of the cathode substrate (3).

5 Claims, 6 Drawing Sheets

GETTER CHAMBER FOR FLAT PANEL DISPLAYS

BACKGROUND OF THE INVENTION

This invention relates to a vacuum electronic device such as a fluorescent display device or the like and an envelope therefor, and more particularly to a structure for evacuating an envelope to keep it at a high vacuum.

In general, a conventional fluorescent display device includes an envelope kept at a high vacuum, in which a cathode for emitting electrons is arranged. Also, the envelope is provided on an inner surface thereof with a display section including phosphor layers and anode conductors and arranged opposite to the cathode. Also, the envelope is provided therein with control electrodes so as to be positioned between the cathode and the display section, as required. The fluorescent display device thus constructed causes electrons emitted from the cathode to be selectively impinged on the phosphor layers, to thereby provide a desired luminous display.

The cathode comprises a filamentary cathode adapted to be electrically heated to emit thermions, a cold cathode such as a field emission cathode, or the like.

The envelope is formed of a substrate on which the above-described display section is provided, a cover plate arranged oppositely to the substrate, and side plates constituting a side wall of the envelope. The substrate or cover plate is provided with an evacuation tube or an evacuation hole, through which the envelope is evacuated. Thereafter, the evacuation tube is sealed or the evacuation hole is closed with a lid member or the like, resulting in the envelope being kept at a high vacuum. Alternatively, the side wall of the envelope is provided with an evacuation tube, through which the envelope is evacuated, followed by closing of the evacuation tube.

Unfortunately, the above-described conventional envelope for the fluorescent display device meets with several disadvantages.

More particularly, in order that sealing of the envelope after evacuation of the envelope through the substrate or cover plate opposite to the substrate permits the envelope to be kept at a high vacuum, in is required than the substrate or cover plane is formed with such an evacuation hole as described above. Unfortunately, this leads to problems due to dusts, contamination, cracks of the substrate or the like occurring during formation of the evacuation hole. In particular, when it is required to subject both substrate end cover plate to fine processing as seen in the fluorescent display device having a field emission cathode incorporated therein, dusts or contamination occurring during formation of the evacuation hole often adversely affects the fine processing. Also, the evacuation hole per se adversely affects an exposure step or the like in the fine processing, resulting in the fine processing being failed.

Another disadvantage of the conventional fluorescent display device is that arrangement of several evacuation holes at the substrate causes cracks to occur in the substrate and the like.

SUMMARY OF THE INVENTION

The present invention has been made in view of the foregoing disadvantage of the prior art.

Accordingly, it is an object of the present invention to provide an envelope which is capable of being kept at a high vacuum without separately or independently forming a substrate and a cover plate opposite to the substrate with any specific evacuation hole.

It is another object of the present invention to provide a fluorescent display device which is capable of permitting an envelope to be kept at a high vacuum without independently forming a substrate and a cover plate opposite to the substrate with any specific evacuation hole.

In accordance with one aspect of the present invention, an envelope for a vacuum electronic device is provided. The envelope is formed of a first substrate, a second substrate and a side wall, wherein any one of the first and second substrates has an evacuation section which is formed with an evacuation hole connected thereto.

In accordance with another aspect of the present invention, a vacuum electronic device is provided. The vacuum electronic device includes an envelope which includes a first substrate provided thereon with an electron emitting cathode, a second substrate provided thereon with a phosphor-deposited display section and arranged so as to be opposite to the first substrate at a predetermined interval and a side wall arranged between the substrate and the second substrate so as to extend along an outer periphery of the first and second substrate and which is kept at a high vacuum, to thereby permit electrons emitted from the cathode to be selectively impinged on the display section to provide a desired luminous display. One of the first substrate and second substrates comprises an electrode formation section on which one of the cathode and display section is provided and an evacuation section formed with at least one evacuation hole which is sealed after evacuation of the envelope.

In a preferred embodiment of the present invention, the evacuation hole is constituted by cooperation of a cutout formed at a side end surface of the evacuation section with a side end surface of the electrode formation section.

In a preferred embodiment of the present invention, the evacuation hole comprises a through-hole formed via the evacuation section.

In accordance with this aspect of the present invention, a fluorescent display device is provided, which includes an envelope adapted to be kept airtight and having an electron emitting cathode and a phosphor-deposited display section arranged therein, resulting in electrons emitted from the cathode being selectively impinged on the display section to provide a desired luminous display. The envelope is formed at a side thereof with an evacuation hole. The envelope is provided on an outside thereof with at least one evacuation chamber. The evacuation chamber is arranged so as to communicate with the evacuation hole, to thereby permit the envelope to be evacuated through the evacuation hole.

Also, in accordance with this aspect of the present invention, a fluorescent display device is provided. The fluorescent display device includes an envelope formed of a substrate, a cover plate arranged oppositely to the substrate at a predetermined interval and a side wall arranged between the substrate and the cover plate and adapted to be kept airtight, and a cathode and a display section each arranged in the envelope, resulting in at least one of the substrate and cover plate being provided with a non-opposite section which is not opposite to the other of the substrate and cover plate. The side wall is provided at a portion thereof corresponding to the non-opposite section with at least one evacuation hole. The non-opposite section is formed with at least one evacuation chamber and the evacuation chamber is arranged so as to communicate with the evacuation hole, to thereby permit the envelope to be evacuated through the evacuation hole.

In a preferred embodiment of the present invention, the evacuation chamber is provided therein with a getter.

In a preferred embodiment of the present invention, the evacuation chamber is mounted with an exhaust tube through which the envelope is evacuated.

In a preferred embodiment of the present invention, the evacuation chamber is provided with an opening, which is then closed with a lid after evacuation of the envelope.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 3(*b*) is a sectional view of the getter chamber shown in FIG. 3(*a*);

FIG. 9(*b*) is a sectional view taken along line a—a of FIG. 9(*a*);

FIG. 13(*b*) is a sectional view taken along line b—b of FIG. 13(*a*).

DETAILED DESCRIPTION OF THE PREFERRED EMBODIMENTS

Figure 1:
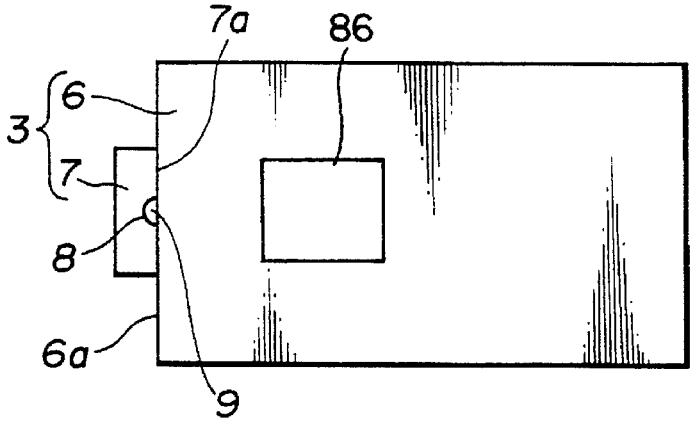
FIG. 1 is a plan view showing a cathode substrate in a first embodiment of a vacuum electronic display device according to the present invention.

Now, the present invention will be described hereinafter with reference to the accompanying drawings.

Referring first to FIGS. 1 to 5, a first embodiment of a vacuum electronic device according to the present invention is illustrated. A vacuum electronic device of the illustrated embodiment is generally designated at reference numeral 1 and in the form of a fluorescent display device. The fluorescent display device includes an envelope 2 adapted to be kept at a high vacuum. The envelope 2 includes a first substrate or cathode substrate 3 which is provided on an inner surface thereof with a field emission cathode 86 acting as a cathode of the device, a second substrate or anode substrate which is provided on an inner surface thereof with a display section including a phosphor layer, and a seal member 5 interposedly arranged between the cathode substrate 3 and the anode substrate 4 to sealedly join both substrates to each other therethrough while keeping them spaced at a predetermined interval from each other and constituting a peripheral sidewall of the envelope 2. The fluorescent display device thus constructed permits electrons emitted from the cathode to be selectively impinged on the display section to thereby provide a desired luminous display.

The cathode substrate 3 may be constructed in such a manner as shown in FIG. 1. The cathode substrate 3 may be formed by adhesively joining two plate members made of an insulating material such as glass or the like to each other. More particularly, the cathode substrate 3 comprises a relatively large plate member 6 constituting an electrode formation section and a relatively small plate member 7 constituting an evacuation section. The relatively small plate member or evacuation section 7 is adhered to a side end surface 6*a* of the relatively large plate member or electrode formation section 6 by means of low-melting glass. The electrode formation section 6 is provided on an inner surface thereof with a field emission cathode. The evacuation section 7 is formed on a side end surface a thereof with a cutout 8 of a substantially half-round shape, so that an evacuation hole 9 is provided between the side end surface 6*a* of the electrode formation section 6 and the side end surface 7*a* of the evacuation section 7.

Figure 2:
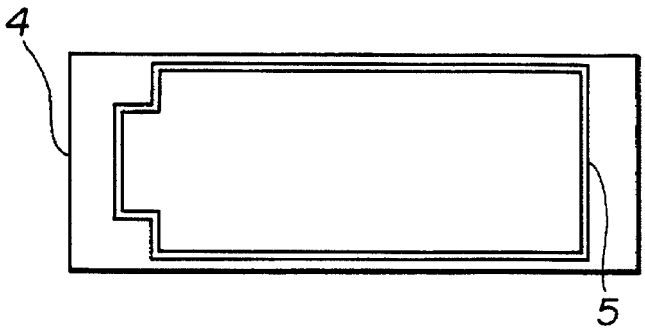
FIG. 2 is a plan view showing an anode substrate in a first embodiment of a vacuum electronic display device according to the present invention.
Figure 3A:
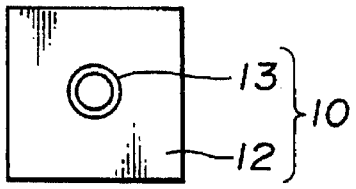
FIG. 3(*a*) is a plan view showing a getter chamber in in a first embodiment of a vacuum electronic display device according to the present invention.
Figure 3B:
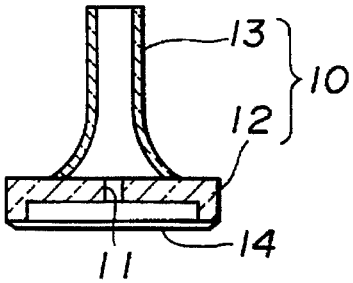
Figure 4:
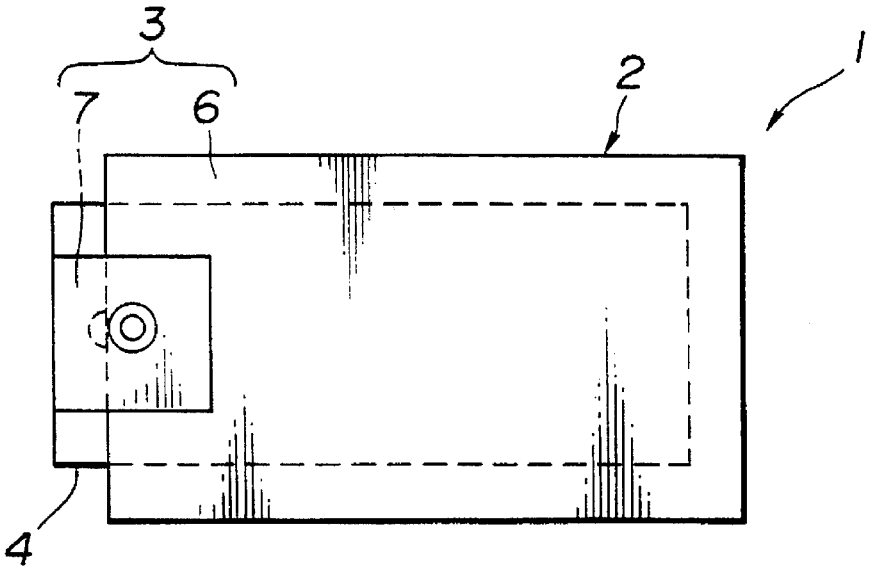
FIG. 4 is a plan view showing a first embodiment of a vacuum electronic device according to the present invention.
Figure 5:
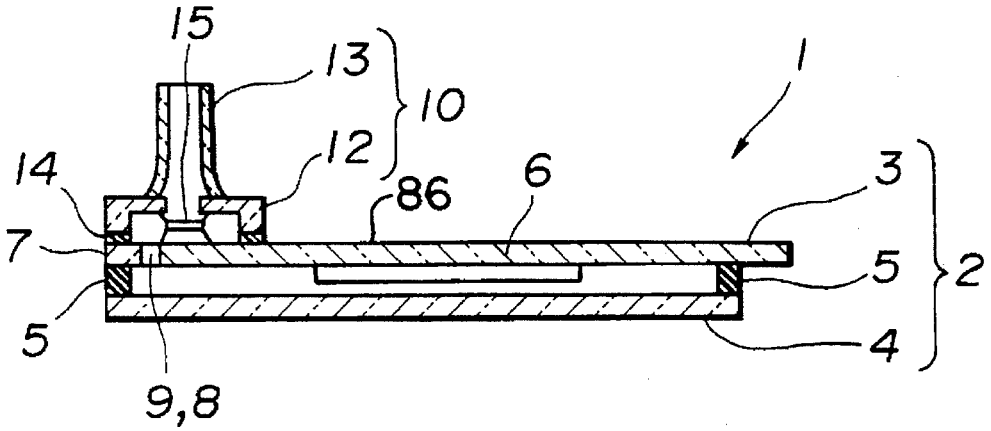
FIG. 5 is a sectional view of the vacuum electronic device shown in FIGURE 4.

The anode substrate 4 may be constructed in such a manner as shown in FIG. 2. The anode substrate 4 comprises a single plate member made of an Insulating material such as glass or the like and is formed into outer dimensions somewhat smaller than the cathode substrate 3. The anode substrate 4 has an inner surface arranged so as to he opposite to an inner surface of the cathode substrate 3 with a predetermined interval being defined therebetween. The inner surface of the anode substrate 4 is provided on a peripheral portion thereof with the above-described seal member 5 serving as the side wall of the envelope 2. As will be noted from FIGS. 1 and 2, the seal member 5 is formed into a configuration corresponding to an outer configuration of the cathode substrate 3, so that a combination of the seal member 5 with the cathode substrate 3 permits the evacuation hole 9 to be positioned inside the seal member 5. The seal member 5 is made of a low-melting glass material. Note specifically, it is made by depositing a paste-like low-melting glass material on the anode substrate 4 and then subjecting it to calcination. The anode substrate 4 is formed on a portion of the inner surface thereof positioned inside the seal member 5 with a display section which includes an anode conductor and a phosphor layer deposited on the anode conductor.

The fluorescent display device 1 further includes a getter chamber member 10 in which a getter chamber is defined. The getter chamber member 10 includes a chamber body 12 which is formed at a center of a bottom wall thereof with an opening and formed at a top wall thereof with an aperture 11, as well as an evacuation tube 13 provided on the top wall thereof so as to communicate with the aperture 11. The chamber body 12 of the getter chamber member 10 is provided on the bottom wall thereof with a seal member 14.

Assembling of the fluorescent display device 1 of the illustrated embodiment constructed as described above, as shown in FIGS. 4 and 5, is carried out by combining the cathode substrate 3 and anode substrate 4 with each other through the seal member 5. Then, the getter chamber member 10 is mounted on the cathode substrate 3 through the seal member 14 so as to be positioned on the evacuation hole 9 of the cathode substrate 3. The getter chamber member 10 has a getter 15 previously received therein. The parts thus assembled are held together by means of a clip or the like. Then, the parts are heated in a vacuum atmosphere or an inert gas atmosphere to melt the seal member 5 and 14, resulting in being adhesively joined together therethrough, so that the envelope 2 and fluorescent display device 1 may be provided. Thereafter, the envelope 2 thus formed is evacuated through the evacuation tube 13, followed by sealing of the evacuation tube 13, resulting in being kept at a high vacuum.

As can be seen from the foregoing, the fluorescent display device of the illustrated embodiment eliminates a necessity of separately or independently forming any evacuation hole at the electrode formation section 6 of the cathode substrate 3, to thereby prevent damage to the cathode substrate 3 and contamination thereof. This permits the field emission cathode to be arranged on the cathode substrate 3 with high accuracy. Also, the evacuation hole is provided at the evacuation section, to thereby permit a configuration of the evacuation hole and a size thereof to be determined at a relatively increased degree of freedom, resulting in the evacuation being accomplished at increased conductance.

Further, the fluorescent display device 1 of the illustrated embodiment has the field emission cathode or flat-type cathode incorporated therein as an electron source, so that a distance between the cathode substrate 3 and the anode substrate 4 may be highly reduced while ensuring that the evacuation hole 9 of a sufficient area is provided at the end of the envelope 2. Also, sealing of the envelope is facilitated by merely closing the evacuation hole 13.

Figure 6:
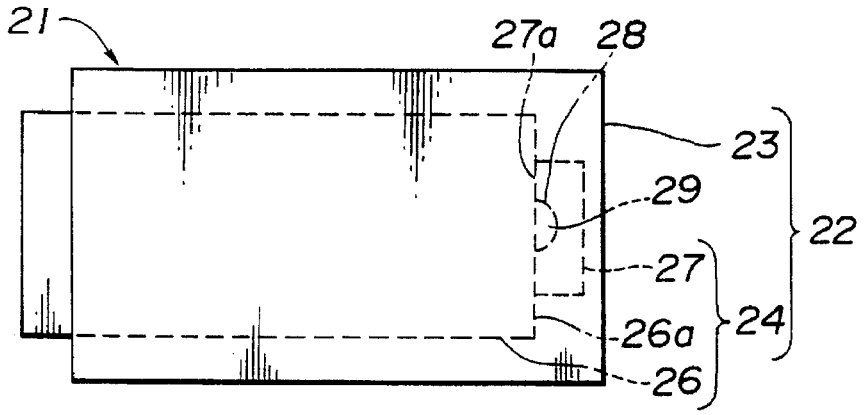
FIG. 6 is a plan view showing a second embodiment of a vacuum electronic device according to the present invention.

Referring now to FIG. 6, a second embodiment of a fluorescent display device according to the present invention is illustrated. A fluorescent display device of the illustrated embodiment which is generally designated at reference numeral 21 includes an envelope 22 constructed by joining an anode substrate 24 and a cathode substrate 23 to each other through a seal member as in the first embodiment described above.

In the illustrated embodiment, the anode substrate 24 is formed of two plate members made of an insulating material such as a material glass or the like and jointed or adhered to each other. More particularly, the anode substrate 24 is formed of a relatively large plate member constituting an electron formation section 26 and a relatively small plate member constituting an evacuation section 27 adhered to a side end surface of the electrode formation section 26 through low-melting glass. The electrode formation section 26 is formed on an inner surface thereof with a display section (not shown) including a phosphor-deposited anode conductor and arranged in a predetermined pattern. The evacuation section 27 has a side end surface 27*a* formed with a cutout 28 of a half-round shape, which cooperates with a side end surface 26*a* of the electrode formation section 26 to form an evacuation hole 29 therebetween.

The cathode substrate 23 is made of a single glass plate larger than the electrode formation section 26 of the anode substrate 24 and provided on an inner surface thereof with a field emission cathode. The anode substrate 24 and cathode substrate 23 are arranged so as to be opposite to each other at a predetermined interval and joined at an outer periphery thereof to each other through the seal member, resulting in the above-described envelope 22 being provided. In the second embodiment, a getter chamber member and seal members (not shown) may be constructed in substantially the same manner as those of the first embodiment described above.

Thus, the fluorescent display device of the illustrated embodiment eliminates a necessity of independently forming any evacuation hole at the electrode formation section 26 of the anode substrate 24, to thereby prevent damage to the anode substrate 24 and contamination thereof. This permits the display section to be arranged in a complicated and fine pattern on the anode substrate 24 with high accuracy. Also, the embodiment likewise exhibits substantially the same advantage as the first embodiment.

Figure 7:
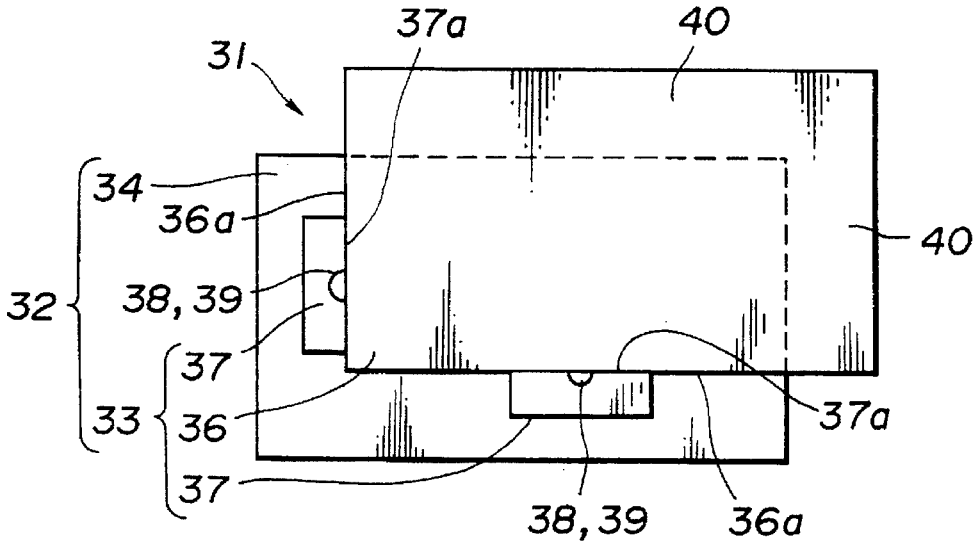
FIG. 7 is a plan view showing a third embodiment of a vacuum electronic device according to the present invention.

Referring now to FIG. 7, a third embodiment of a fluorescent display device according to the present invention is illustrated. A fluorescent display device of the third embodiment which is general designated at reference numeral 31 includes an anode substrate 34 and a cathode substrate 33 sealedly joined to the anode substrate 34 through a seal member as in the first embodiment described above.

The cathode substrate 33 is formed of three plate members made of an insulating material such as glass or the like and adhered together. More particularly, the cathode substrate 33 includes a relatively large plate member of a rectangular shape constituting an electrode formation section 36 and two relatively small plate members of a rectangular shape constituting evacuation sections 37 and adhesively joined to two of side end surfaces of the electrode formation section 36 adjacent to each other by means of low-melting glass. The electrode formation section 36 is formed on an inner surface thereof with a field emission cathode (not shown). The evacuation sections 37 each are formed on a side end surface 37*a* thereof facing the side end surface 36*a* of the electrode formation section 36 with a cutout 38 of a substantially half-round, which cooperates with each of the side end surfaces 36*a* of the electrode formation section 36 to form an evacuation hole 39.

The anode substrate 34 is formed of a single glass plate of a size equal to the electrode formation section 36 of the cathode substrate 33. The anode substrate 34 is formed on an inner surface thereof with a display section (not shown) including a phosphor-deposited anode conductor arranged in a predetermined pattern. The anode substrate 34 and cathode substrate 33 are arranged oppositely to each other at a predetermined interval while being kept diagonally deviated from each other in a horizontal direction and then sealedly joined at an outer periphery thereof to each other through the seal member, resulting in the envelope 32 being provided with two such evacuation holes 39 while being kept airtight.

As will be noted from the above, the envelope 32 of the fluorescent display device of the illustrated embodiment is so constructed that a portion of the cathode substrate 33 at which the two evacuation sections 37 are arranged is outwardly projected as indicated at reference numeral 40 in FIG. 7. Thus, when the portion 40 is used as en external terminal for the field emission cathode, electrical connection between the field emission cathode and a drive section provided outside the envelope 32 is facilitated. For example, cathode conductors formed with emitters and gate electrodes may be arranged so as to cooperate with each other to form a matrix, to thereby form the field emission cathode into a flat configuration. In such arrangement, terminals of the cathode conductors and gate electrodes may be arranged on the projected portion. 40 of the cathode substrate 33.

Thus, it will be noted that the fluorescent display device 31 of the illustrated embodiment exhibits substantially the same advantage as the embodiments described above, as well as an advantage of permitting the envelope 32 to be evacuated at increased conductance due to arrangement of two such evacuation holes 39.

Figure 8A:
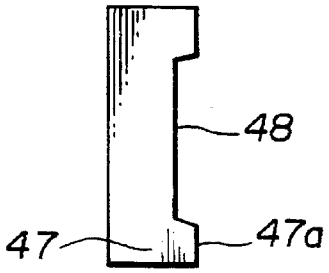
FIGS. 8(*a*) and 8(*b*) each are a plan view showing an evacuation section in a vacuum electronic device according to the resent invention.
Figure 8B:
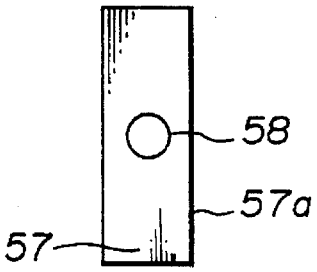

In each of the embodiments described above, the evacuation hole of the envelope is formed into a half-round shape. Alternatively, it may be formed into any other suitable shape. For example, in a modification shown in FIG. 8(*a*), a cutout 48 of an evacuation section 47 connected to an electrode formation section is formed into a shape like a groove of a rectangle-in section. Alternatively, in another modification shown in FIG. 8(*b*), a cutout 58 of an evacuation section 57 comprises a through-hole formed into a round shape in section.

Also, in each of the above-described embodiments, the side end surface of the evacuation section connected to the electrode formation section is formed into a length smaller than the side end surface of the electrode formation section corresponding thereto. Alternatively, the side end surfaces of both sections may be formed into the same length. Such construction reduces unevenness in configuration of the envelope, Further, the embodiments described above each are so constructed that the field emission cathode acting as a cathode for the fluorescent display device is formed directly on the cathode substrate. Alternatively, the field emission cathode may be arranged through a suitable element such as a Si substrate or the like on the cathode substrate. This is true of the display section formed on the anode substrate.

Moreover, the embodiments described above is directed the fluorescent display device which is merely one example of the vacuum electronic device of the present invention. Thus, the present invention may be embodied in a vacuum electronic device of another type. For example, the present invention may be applied to a magnetic detection device including a field emission cathode arranged in an envelope kept at a high vacuum, wherein the field emission cathode is affected by a magnetic field outside the envelope.

Figure 9A:
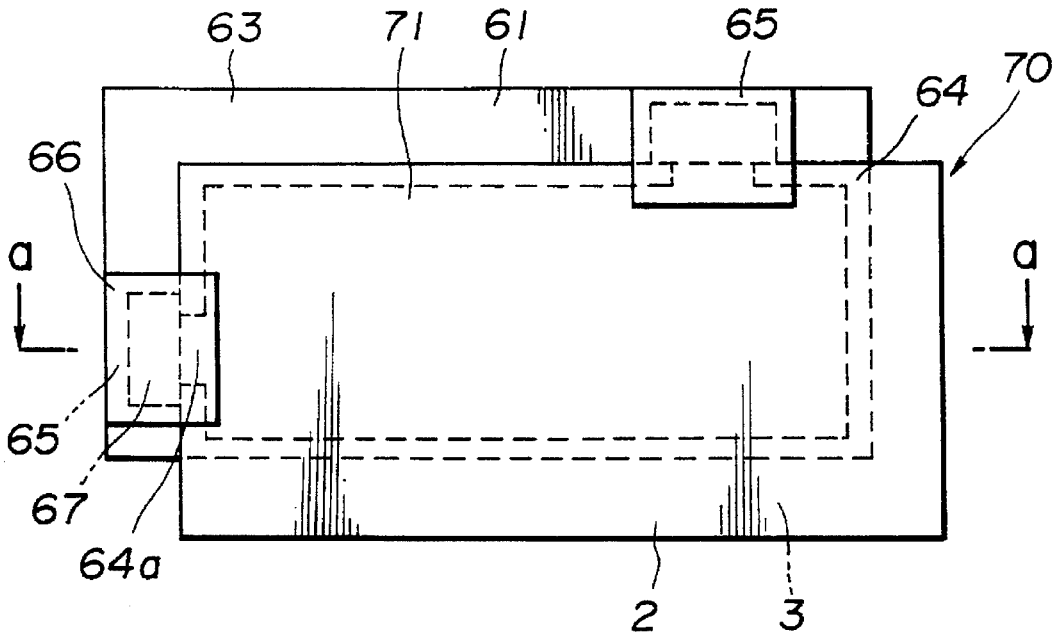
FIG. 9(*a*) is a plan view showing a fourth embodiment of a vacuum electronic device according to the present invention.
Figure 9B:
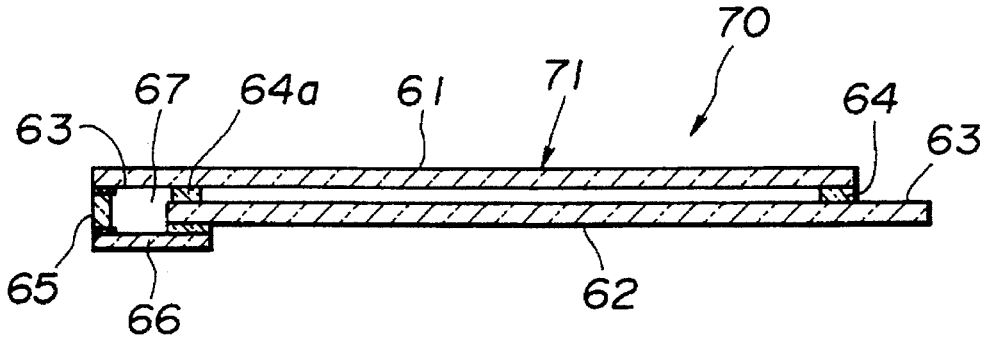

Referring now to FIGS. 9(*a*) and 9(*b*), a fourth embodiment of a fluorescent display device according to the present invention is illustrated. A fluorescent display device of the fourth embodiment generally designated at reference numeral 70 includes an envelope 71 formed of a substrate 61, a cover place 62 arranged oppositely to the substrate 61 at a predetermined interval, and side plates 64 provided between the substrate 61 and the cover plate 62 and constituting a side wall of the envelope 71.

The substrate 61 is formed of a light-permeable insulating material into a rectangular shape and provided on an inner surface thereof with a display section (not shown) including a light-permeable anode conductor and a phosphor layer deposited thereon. The cover plate 62 is formed of an insulating material into substantially the same configuration as the substrate 61, The substrate 61 and cover plate 62, as shown in FIG. 9(*a*), are arranged oppositely to each other while being kept deviated from each other in a horizontal direction as in the embodiment of FIG. 6, so that both have non-opposite sections 63 kept from facing each other. The side plates 64 are arranged between the substrate 61 and cover plate 62 so as to surround portions of the substrate 61 and cover plate 62 facing each other. Thus, the field emission cathode and display section are received in the envelope 71 of a thin box-like shape and externally fed with electric power through a wiring conductor (not shown) provided at the non-opposite sections 63.

The side wall 64 of the envelope 71 is partially cut off, to thereby be provided with evacuation holes 64*a* communicating with an inner space of the envelope 71. The non-opposite section 63 of the substrate 61 and the side wall 64 of the envelope 71 are commonly mounted on each of portions thereof in proximity to the evacuation holes 64*a* with a spacer member 65 through a fixture, to thereby provide an evacuation chamber 67 communicating with each of the evacuation holes 64*a*.

The envelope 71 thus constructed is then evacuated through the evacuation chambers 67 and evacuation holes 64*a*, to thereby be kept at a high vacuum. Then, the evacuation chambers 67 each are tightly closed by a lid of a rectangular shape, resulting in the envelope 71 being sealed.

The fluorescent display device 70 of the illustrated embodiment has the field emission cathode or flat-type cathode incorporated therein as an electron source therefor, so that a distance between the substrate 61 and the opposite cover plate 62 may be highly reduced while ensuring that the evacuation holes 64*a* of a sufficient area are provided at the side wall of the envelope 71. Also, sealing of the envelope 71 is facilitated by merely closing the evacuation chambers 67. Further, the illustrated embodiment eliminates a necessity of independently forming the substrate 61 and cover plate 62 with any specific evacuation hole to thereby solve the above-described problems. Further, the evacuation chambers 67 are arranged at the non-opposite section 63 of the substrate 61 positioned outside the envelope 71, so that an increase in thickness of the envelope 71 due to arrangement of the evacuation chambers 67 is limited to a level of a thickness of the lids 66, so that the whole envelope may be constructed in a compact manner.

Figure 10:
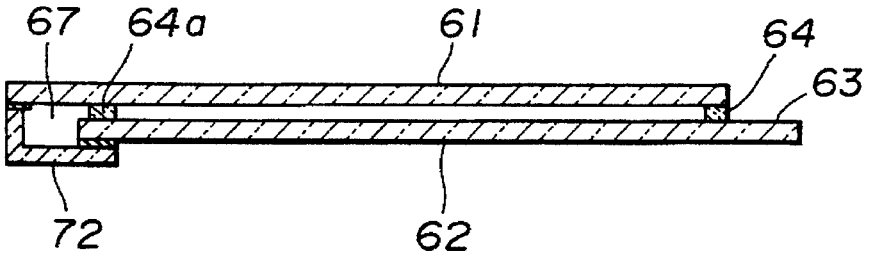
FIG. 10 is a plan view showing a fifth embodiment of a vacuum electronic device according to the present invention.

Referring now to FIG. 10, a fifth embodiment of a fluorescent display device according to the present invention is illustrated. Parts of the fifth embodiment constructed in a manner like those of the fourth embodiment are designated by like reference numerals. A fluorescent display device of the fifth embodiment is so constructed that evacuation chambers 67 each are defined by a box-like member 72 integrally formed. The remaining part of the fifth embodiment may be constructed in substantially the same manner as the fourth embodiment.

Figure 11:
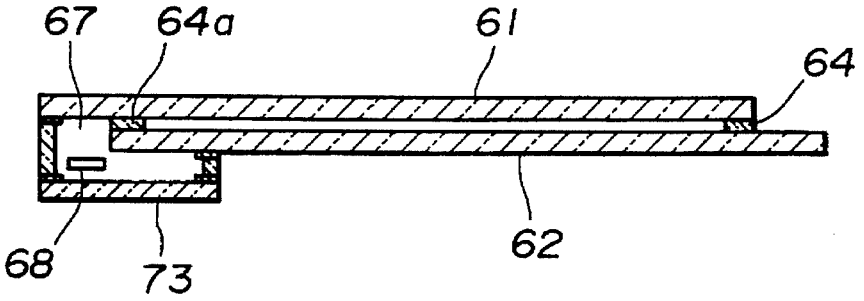
FIG. 11 is a plan view showing a sixth embodiment of a vacuum electronic device according to the present invention.
Figure 12:
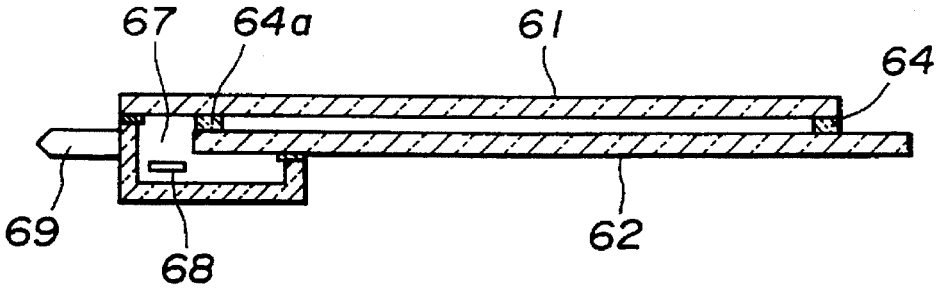
FIG. 12 is plan view showing a seventh embodiment of a vacuum electronic device according to the present invention.

FIGS. 11 and 12 show sixth and seventh embodiments of a fluorescent display device according to the present invention respectively. In each of the sixth and seventh embodiments, a getter 68 is arranged in each of evacuation chambers 67, so that the evacuation chamber 67 ma function also as a getter chamber. The getter 68 may comprise a getter of the special type such as an activated getter or the like. Alternatively, it may comprise a getter of the normal type such as a getter fed with electricity, a high-frequency heating getter or the like.

In each of the embodiments shown in FIGS. 11 and 12 the evacuation chambers 67 each are formed into a size which permits the getter 68 to be received in the chamber 67 and a getter film to be formed therein. Sealing of the evacuation chamber 67, as shown in FIG. 11, may be carried out by means of a lid member 73 as in the embodiment of FIG. 9. Alternatively, it may be carried out by means of an evacuation tube 69 mounted on a relatively large side wall of the evacuation chamber 67 as shown in FIG. 12.

The remaining part of the sixth and seventh embodiments ma be constructed in substantially the same manner as the fourth embodiment described above.

Figure 13A:
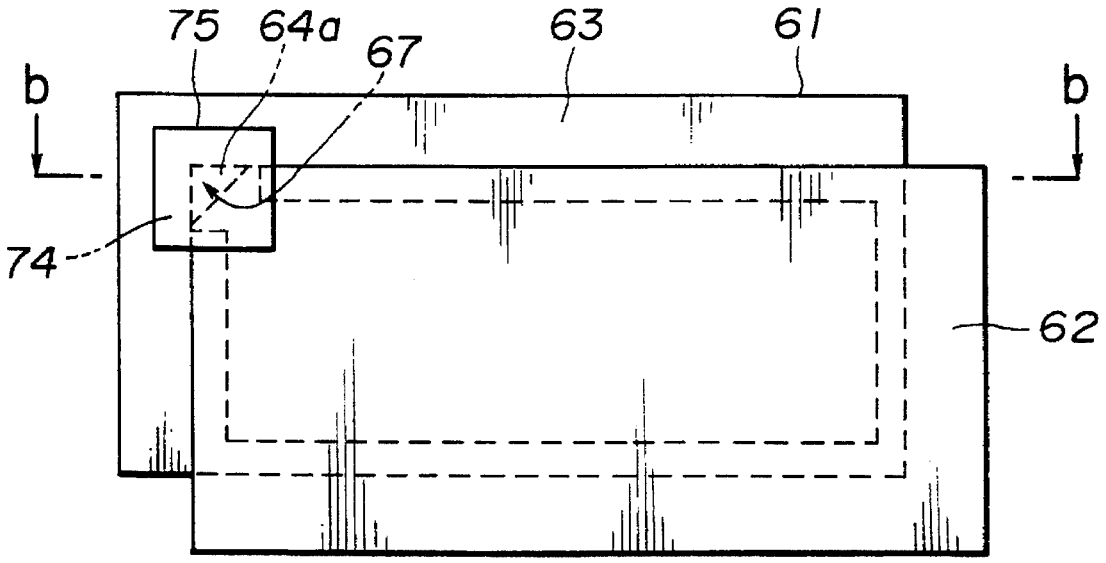
FIG. 13(*a*) is a plan view showing an eighth embodiment of a vacuum electronic device according to the present invention.
Figure 13B:
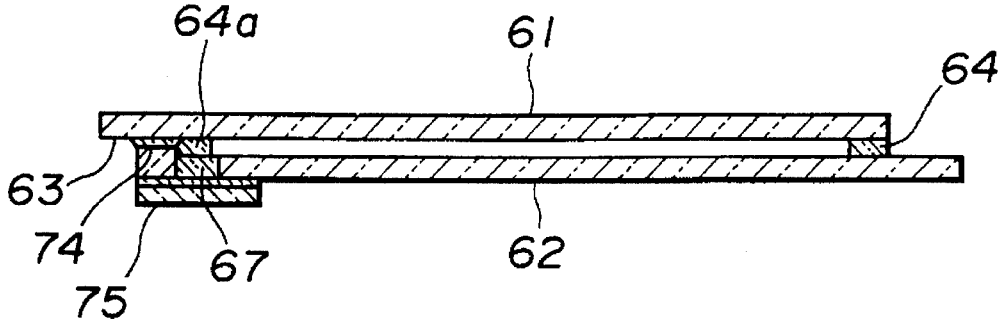

Referring further to FIGS. 13(*a*) and 13(*b*), an eighth embodiment of fluorescent display device according to the present invention is illustrated. In the illustrated embodiment, an opposite cover plate 62 is cut off at a corner thereof into a triangular shape and a portion of a side wall of an envelope corresponding to the cut-off corner is cut off, resulting in providing an evacuation hole 64*a*. Then, a spacer member 74 is fixedly mounted on a non-opposite section 63 of a substrate 61 corresponding to the evacuation hole 64*a* and the cut-off corner of the opposite cover place 62, to thereby provide an evacuation chamber 67, which is then sealedly closed with a plate-like lid member 75. The remaining part of the eighth embodiment may be constructed in substantially the same manner as the fourth embodiment of FIG. 9, As can be seen from the foregoing, the fluorescent display device of the present invention is so constructed that the substrates constituting the envelope comprise the electrode formation section on which the cathode or display section is formed and the evacuation section formed with the evacuation hole, to thereby eliminate a necessity of independently forming the electrode formation section with any specific evacuation hole, resulting in preventing fine processing of the substrate for formation of the cathode or display section from being adversely affected by such a specific evacuation hole of the electrode formation section.

Also, the evacuation hole is provided at the evacuation section, so that a configuration of the evacuation hole and a size thereof may be determined at a relatively increased degree of freedom.

Further, the fluorescent display device of the present invention may permit two or more such evacuation holes to be formed at the periphery of the substrate, so that evacuation of the envelope may be accomplished at increased conductance.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising an envelope adapted to be kept airtight and having an electron emitting cathode and a phosphor-deposited display section arranged therein, resulting in electrons emitted from said cathode being selectively impinged on said display section to provide a desired luminous display;

said envelope being formed at a side thereof with an evacuation hole;

said envelope being provided on an outside thereof with at least one evacuation chamber;

said evacuation chamber being arranged so as to communicate with said evacuation hole, to thereby permit said envelope to be evacuated through said evacuation hole.

2. A fluorescent display device as defined in claim 1 or 6, wherein said evacuation chamber is provided therein with a getter.

3. A fluorescent display device as defined in claim 1 or 6, wherein said evacuation chamber is mounted with an exhaust tube through which said envelope is evacuated.

4. A fluorescent display device as defined in claim 1 or 6, wherein said evacuation chamber is provided with an opening;

said opening being closed with a lid after evacuation of said envelope.

5. A fluorescent display device comprising:

an envelope formed of a substrate, a cover plate arranged oppositely to said substrate at a predetermined interval and a side wall arranged between said substrate and said cover plate, and adapted to be kept airtight; and a cathode and a display section each arranged in said envelope, resulting in at least one of said substrate and cover plate being provided with a non-opposite section which is not opposite to the other of said substrate and cover plate;

said side wall being provided at a portion thereof corresponding to said non-opposite section with at least one evacuation hole;

said non-opposite section being formed with at least one evacuation chamber;

said evacuation chamber being arranged so as to communicate with said evacuation hole, to thereby permit said envelope to be evacuated through said evacuation hole.

* * * * *